US007228922B1

(12) United States Patent
DeVall

(10) Patent No.: US 7,228,922 B1
(45) Date of Patent: Jun. 12, 2007

(54) DRILL BIT

(76) Inventor: Donald L. DeVall, 1082 Charles Ave., Morgantown, WV (US) 26505

( * ) Notice: Subject to any disclaimer, the term of this patent is extended or adjusted under 35 U.S.C. 154(b) by 212 days.

(21) Appl. No.: 10/863,789

(22) Filed: Jun. 8, 2004

(51) Int. Cl.
*E21B 10/43* (2006.01)
*B23B 51/02* (2006.01)

(52) U.S. Cl. ..... 175/397; 175/398; 175/427; 408/228

(58) Field of Classification Search ..... 175/57, 175/398, 397, 378, 376, 420.1, 427, 421; D15/132, 139; 407/56, 60–62; 408/223, 408/227, 228
See application file for complete search history.

(56) References Cited

U.S. PATENT DOCUMENTS 1,809,351 A * 6/1931 Oliver ..... 175/397
1,923,488 A 8/1933 Howard et al.
1,940,996 A * 12/1933 Carr ..... 175/397
2,032,328 A 2/1936 Reedy
2,358,052 A 9/1944 Brown
2,461,305 A * 2/1949 Winn ..... 175/397
2,648,524 A 8/1953 Dionisotti
D178,899 S 10/1956 Olsen
2,815,933 A 12/1957 Dionisotti
D183,237 S 7/1958 Aven, Jr.
3,140,748 A 7/1964 Engle et al.
3,179,190 A 4/1965 Blasi
4,098,362 A 7/1978 Bonnice
4,211,294 A 7/1980 Multakh
4,259,090 A 3/1981 Bovenkerk
4,294,319 A * 10/1981 Guergen ..... 175/389
4,313,506 A 2/1982 O'Connell
4,440,247 A 4/1984 Sartor
4,471,845 A 9/1984 Jurgens
4,499,958 A 2/1985 Radtke et al.
4,534,773 A 8/1985 Phaal et al.
4,729,441 A 3/1988 Peetz et al.
4,733,735 A 3/1988 Barr et al.
4,771,834 A 9/1988 Treitz
D317,010 S 5/1991 Knemeyer
5,180,022 A 1/1993 Brady
5,184,689 A 2/1993 Sheirer et al.
D340,248 S 10/1993 Brady (Continued)

FOREIGN PATENT DOCUMENTS

WO WO 8900473 * 1/1989

OTHER PUBLICATIONS

Abrasive Technology Everlast® Brand PCD Drill Product Profile downloaded from www.abrasive-tech.com on Aug. 3, 2003.

(Continued)

*Primary Examiner*—Kenneth Thompson
(74) *Attorney, Agent, or Firm*—Price & Adams

(57) ABSTRACT

A drill bit has a pair of cutting teeth with cutting elements extending from a cutting end portion of the drill bit. Each cutting tooth extends radially, outwardly parallel to a longitudinal axis of the drill steel. The cutting teeth are juxtaposed with one another on the longitudinal axis. Each cutting tooth includes a plurality of raised cutting elements connected to a plurality of lowered edge portions. The cutting elements produce concentric circular channels in the working surface of a rock formation, as the drill bit rotates during the cutting operation. The drill bit also includes a pocket for accumulating and removing dislodged material during the cutting operation.

25 Claims, 4 Drawing Sheets

U.S. PATENT DOCUMENTS

| | | | | |
|---|---|---|---|---|
| 5,303,787 | A | 4/1994 | Brady | |
| D351,174 | S | 10/1994 | Brady | |
| 5,363,932 | A | 11/1994 | Azar | |
| 5,433,281 | A | 7/1995 | Black | |
| 5,467,837 | A | 11/1995 | Miller et al. | |
| 5,535,839 | A | 7/1996 | Brady | |
| 5,580,196 | A | 12/1996 | Thompson | |
| 5,630,478 | A | 5/1997 | Schimke | |
| 5,743,346 | A | 4/1998 | Flood et al. | |
| 5,875,858 | A | 3/1999 | Brady | |
| 5,996,714 | A | 12/1999 | Massa et al. | |
| 6,021,857 | A | 2/2000 | Birk et al. | |
| 6,029,544 | A | 2/2000 | Katayama | |
| D424,579 | S | 5/2000 | Brady | |
| 6,092,612 | A | 7/2000 | Brady | |
| D430,578 | S | 9/2000 | Brady | |
| 6,161,635 | A | 12/2000 | Brady | |
| 6,260,638 | B1 | 7/2001 | Massa et al. | |
| 6,290,007 | B2 | 9/2001 | Beuershausen et al. | |
| 6,374,932 | B1 | 4/2002 | Brady | |
| 6,427,782 | B2 | 8/2002 | Brady | |
| 6,585,064 | B2 | 7/2003 | Griffin et al. | |
| 6,588,520 | B2 * | 7/2003 | Hauptmann | 175/430 |
| 2001/0013428 | A1 | 8/2001 | Brady | |

OTHER PUBLICATIONS

Diamatec, Inc. Surface-Set Diamond Core Bits Product Profile downloaded from www.diamatec.com on Aug. 3, 2003.

"Diamond Bits & Tooling for World Markets", GeoDrilling International, Aug. 2002, p. 32.

"Diamond, Diamond-like Carbon/CBN Films and Coated Products: Technology Analysis", Global Information, Inc., Aug. 2002 (outline only).

GeoGem Manufacturing Processes Description downloaded from www.geogem.co.uk on Aug. 3, 2003.

Glowka, David A., "Development of Advanced Synthetic-Diamond Drill Bits for Hard-Rock Drilling", U.S. Department of Energy, Apr. 25, 1997.

Radtke, Bob; Smith, Melody; Riedel, Richard; Daniels, Bill; and Gwilliam, William, "New High Strength and Faster Drilling TSP Diamond Cutters", 1999 Oil and Gas Conference-Technology Options for Producer's Survival, U.S. Department of Energy, Jun. 28-30, 1999.

Wise, Jack L. and Raymond, David, "Hard-Rock Drill Bit Technology", Sandia National Laboratories, Jul. 17, 2003.

* cited by examiner

DRILL BIT

BACKGROUND OF THE INVENTION

1. Field of the Invention

This invention relates to an improved drill bit, and more particularly, to a method and apparatus utilizing cutting teeth and cutting elements positioned on a drill bit to carve concentric circular channels in a working surface as the drill bit rotates.

2. Description of the Prior Art

In the fields of industrial, mining and construction tools, drill bits having complex cutting element arrangements and cutting tool inserts are commonly used. In rock drilling operations, it is the conventionally known practice to drill holes in a rock formation by a rotary drill assembly or by a rotary percussion drill assembly. These assemblies include a drill pot that carries a hydraulic motor having a motor shaft rotatably connected to a bevel gear which meshes with another bevel gear rotatably journaled on a support member or hub within the drill housing. It is affixed to a rotatable head or cover, which has a seat into which the shank of a drill steel is received. A drill bit is positioned on the upper end of the drill steel. With this arrangement, rotation of the motor shaft is transmitted to the drill steel to rotate the drill bit.

Many examples of drill bits are known in the art. U.S. Design Pat. No. 178,899 discloses an ornamental design for a drill bit. The drill bit includes three teeth that extend from the distal end of the drill bit and intersect at a point in the center of the distal end. The teeth are separated by a large angular space. The cutting surface of each tooth includes a series of uniform steps.

U.S. Pat. No. 5,184,689 discloses a rotary drill bit that includes a cylindrical body, two dust openings, and a working surface having an insert. The insert includes a simple tapered edge. The drill bit also includes a back relief surface, which can help to remove dislodged material from a working surface, as the drill bit rotates during drilling operations.

U.S. Pat. No. 5,433,281 discloses a roof drill bit having a plurality of equally spaced cutting elements. The cutting elements are V-shaped, not rounded. The cutting elements are spaced symmetrically about an axis that runs from the connecting end of the drill bit to the distal end of the drill bit.

U.S. Pat. No. 4,771,834 discloses a drill bit that includes a plurality of cutting teeth extending from a cutting surface on the distal end of a drill bit. The cutting teeth also extend radially, outwardly from the center of the cutting surface and intersect at the center point of a cutting surface on the drill bit. Each tooth includes a pair of conical cutting elements symmetrically positioned on the tooth. The bit also includes a plurality of pockets for collecting debris from a working surface.

U.S. Pat. No. 4,471,845 discloses a drill bit that includes a plurality of cutting teeth extending from a cutting surface on the distal end of a drill bit. The cutting teeth also extend radially, outwardly from the center of the cutting surface and intersect at the center point of the cutting surface on the drill bit. Each tooth includes a plurality of rounded cutting elements symmetrically positioned on the tooth.

U.S. Pat. No. 6,290,007 discloses a drill bit that includes a plurality of cutting teeth extending from a cutting surface on the distal end of a drill bit. The cutting teeth also extend radially, outwardly from the center of the cutting surface. Each tooth includes a plurality of cutting elements symmetrically positioned on the tooth. Accordingly, conventional drill bits include symmetrically positioned cutting elements and cutting teeth.

Polycrystalline diamond (PCD) is now in wide use, sometimes called polycrystalline diamond compacts (PDC), in making drill bits. U.S. Pat. No. 6,427,782 discloses that PCD materials that are formed of fine diamond powder sintered by intercrystalline bonding under high temperature/high pressure diamond synthesis technology into predetermined layers or shapes; and such PCD layers are usually permanently bonded to a substrate of "precemented" tungsten carbide to form such PDC insert or compact. The term "high density ceramic" (HDC) is sometimes used to refer to a mining tool having a PCD insert. "Chemical vapor deposition" (CVD) and "Thermally Stable Product" (TSP) diamond-forms may be used for denser inserts and other super abrasive hard surfacing and layering materials, such as layered "nitride" compositions of titanium (TiN) and carbon ($C_2$ $N_2$) and all such "hard surface" materials well as titanium carbide and other more conventional bit materials are applicable to the present invention. Accordingly, there is a need for a unconventional "hard surface" rotary drill bit that has the ability to carve concentric circular channels into a working surface.

SUMMARY OF THE INVENTION

In accordance with the present invention there is provided a drill bit that includes a cylindrical body portion having a longitudinal axis and a cutting end portion. A pair of cutting teeth are positioned on the cutting end portion, each cutting tooth extending radially, outwardly from the longitudinal axis of the cylindrical body portion. Each cutting tooth includes a plurality of raised edge portions connected to a plurality of lower edge portions. The cutting teeth are juxtaposed from one another with a lower edge portion on one tooth in opposition to a raised edge portion on the other tooth.

Further in accordance with the present invention, there is provided a drill bit for drilling a hole in a drilling surface that includes a cylindrical body portion having a longitudinal axis and a cutting end portion. A pair of opposing cutting teeth are positioned on the cutting end portion. Each cutting tooth extends radially, outwardly from the longitudinal axis of the cylindrical body portion. The first cutting tooth has a cutting element for carving a first circular hole in the drilling surface. The second cutting tooth has a cutting element for carving a second, concentric circular hole in the drilling surface adjacent to the first circular hole.

Further in accordance with the present invention, there is provided drill bit for drilling a hole in a drilling surface that includes a cylindrical body portion having a longitudinal axis and a cutting end portion. The cutting end portion has a pair of cutting teeth, each cutting tooth extending radially, outwardly from the longitudinal axis of the cylindrical body portion. A layer of hard material coats the cutting teeth at least partially to form a plurality of spaced cutting elements extending from the cutting teeth. The first cutting tooth has one of the cutting elements positioned to carve a first circular hole in the drilling surface. The second cutting tooth has one of the cutting elements positioned to carve a second, concentric circular hole in the drilling surface adjacent to the first circular hole.

Further in accordance with the present invention, there is provided a method for drilling a hole in a working surface that includes the step of contacting a first cutting element of a first cutting tooth extending from a drill bit with the working surface. The drill bit is rotated to carve a first circular channel in the working surface with the first cutting element. A second cutting element on a second cutting tooth extending from the drill bit contacts the working surface. The drill bit is rotated to carve a second circular channel adjacent to the first circular channel in the working surface with the second cutting element.

Accordingly, a principal object of the present invention is to provide a drill bit having cutting elements for carving concentric circular channels to drill a bore in a working surface.

Another object of the present invention is to provide a more efficient drill bit having a plurality of cutting elements positioned on cutting surfaces to carve concentric circular channels in working surfaces as the drill bit rotates.

A further object of the present invention is to provide a drill bit that carves concentric circular channels in a working surface and collects the debris in a pocket on the drill bit for removal during the rotation of the drill bit.

Another object of the present invention is to provide a hard surface drill bit having asymmetrically spaced cutting elements positioned on cutting surfaces to carve concentric circular channels in working surfaces as the drill bit rotates.

These and other objects of the present invention will be more completely described and disclosed in the following specification, accompanying drawings, and appended claims.

DESCRIPTION OF THE PREFERRED EMBODIMENTS

Rotary drill assemblies are particularly adapted for use in drilling bolt holes in a mine roof of an underground mine, as described in U.S. Pat. No. 4,416,337. A drill steel carries the drill bit at its upper end portion for dislodging rock material. The drill bit and drill steel are mounted in conventional chuck assemblies, as part of a rotary drill assembly. The drill steel and drill bit are centrally bored to facilitate removal from the drilled hole rock dust ground by the bit.

Figure 3:
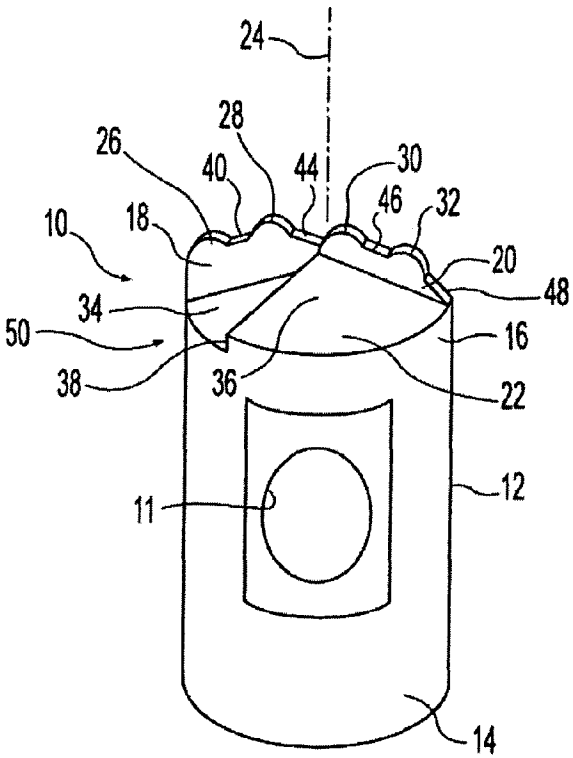
FIG. 3 is an isometric view of the drill bit shown in FIG. 1.
Figure 2:
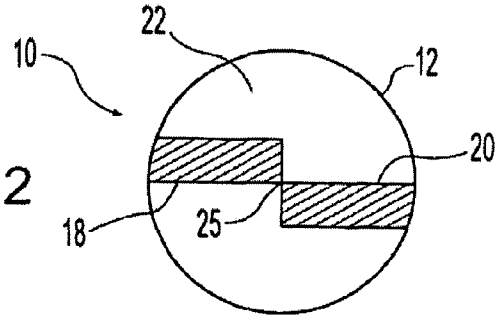
FIG. 2 is a sectional top plan view of the drill bit shown in FIG. 1, illustrating the offset relationship of the asymmetrically positioned cutting teeth.
Figure 1:
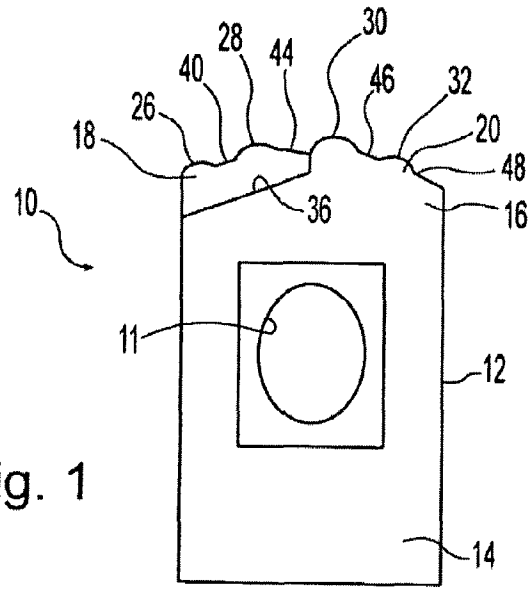
FIG. 1 is a view in side elevation of one embodiment of a drill bit, illustrating a pair of asymmetrically positioned cutting teeth extending in offset relationship on the longitudinal axis of the drill bit.

Referring to the drawings and, particularly, to FIGS. 1–3, there is illustrated an improved drill bit generally designated by the numeral 10. The drill bit 10 has a cylindrical body portion 12 with two opposing dust collection openings 11. The cylindrical body portion 12 includes a drill steel engaging portion 14 at one end and a bit end portion 16 at the opposite end. The drill steel engaging portion 14 attaches to a drill steel (not shown) through conventional connection devices.

The bit end portion 16 includes an integral first cutting tooth 18 and an integral second cutting tooth 20 for contacting and carving a working surface. The cutting teeth 18, 20 extend from the bit end portion 16 of the drill bit 10, and more particularly, from a surface 22 on the bit end portion 16 of the drill bit 10. The cutting teeth 18 and 20 extend in a direction parallel to a longitudinal axis 24 (FIG. 3) of body portion 12 that runs from the drill steel engaging portion 14 of the drill bit 10 to the bit end portion 16 of the drill bit 10. As shown in FIG. 3, the cutting teeth 18 and 20 abut one another at point 25 at the longitudinal axis 24 in a heel-to-toe configuration. With this arrangement the cutting teeth 18 and 20 are laterally displaced or offset from one another, as they extend parallel to the drill bit longitudinal axis.

As shown in FIG. 3, the cutting tooth 18 includes a plurality of integral cutting elements 26, 28. The cutting tooth 20 also includes a plurality of integral cutting elements 30, 32. The cutting elements 26, 28 and 30, 32 carve a working surface. The cutting elements 26, 28 and 30, 32 shown in FIGS. 1–3 are asymmetrically positioned relative to the longitudinal axis 24 and are offset from one another to produce a cutting pattern on a working surface that operates at a lower temperature with a longer bit life. The cutting elements 26, 28 and 30, 32 radiate outwardly from the center of the cutting surface 22 to create the appearance of alternating peaks and valleys when viewed in perspective, as shown in FIG. 3.

As shown in FIG. 2, the cutting teeth 18 and 20 are laterally offset from one another and abut one another at a common point 25 on the surface 22. As shown in FIG. 3, the surface 22 also includes two adjacent surfaces 34, 36 that are separated by a wall 38. The surfaces 34, 36 support the cutting teeth 18 and 20 respectively. The first cutting tooth 18 extends from surface 34. The second cutting tooth 20 extends from surface 36. The surfaces 34 and 36 slope away from the cutting teeth 18 and 20 to provide for efficient evacuation of dislodged materials from the drill bit 10. This permits the drill bit 10 to operate at a lower temperature (has a cooling effect) so that the life of the cutting teeth 18 and 20 is extended.

As shown in FIGS. 1 and 3, the cutting elements 26, 28 and 30, 32 are spaced apart from one another on the cutting teeth 18 and 20, respectively. The cutting elements 26, 28 are separated by a downwardly sloping linear edge portion 40. The first cutting element 26 is positioned adjacent to the cylindrical body portion 12 of the drill bit 10. The second cutting element 28 is positioned adjacent to the center of the surface 34. A second, downwardly sloping linear edge portion 44 extends from the second cutting element 28 to the abutment point 25, as shown in FIG. 2.

As shown in FIG. 1, the downwardly sloping linear edge portions 40, 44 slope in opposite directions. Linear edge portion 40 slopes toward the exterior surface of the cylindrical body portion 12. Linear edge portion 44 slopes downwardly toward the longitudinal axis 24 of body portion 12. Alternatively, the linear edge portions are sloped in the same direction or are flat relative to the surface 34.

As shown in FIG. 1, each cutting element 26, 28 on the cutting tooth 18 has an arcuate configuration and is positioned on the cutting tooth 18 to create a unique cutting pattern on a working surface. The cutting tooth 18 is not limited to elements 26, 28. Additional cutting elements can be added as necessary. Preferably, the cutting elements 26, 28 have a width corresponding to the width of the linear edge portion 40. However, the width of the cutting elements 26, 28 is not critical.

The cutting elements 30, 32 of the second cutting tooth 20 are also spaced from one another by a downwardly sloping linear edge portion 46. The first cutting element 30 is positioned adjacent to the body portion longitudinal axis 24, shown in FIG. 3. The second cutting element 32 is positioned adjacent to the exterior surface of the body portion 12. A downwardly sloping linear edge portion 48 is positioned adjacent to the second cutting element 32. The linear edge portion 44 of cutting tooth 18 abuts the cutting element 30 of cutting tooth 20 along the longitudinal axis 24.

The linear edge portions 46, 48 slope downwardly in the same direction, as seen in FIGS. 1 and 3. The linear edge portions 46, 48 also slope toward the exterior surface of the cylindrical body portion 12. The linear edge portions 46, 48 are sloped in the same direction in one embodiment and in another embodiment are flat relative to the cutting surface 36.

Each cutting element 30, 32 has an arcuate configuration on the cutting tooth 20. The cutting tooth 20 is not limited to the two cutting elements 30, 32. The cutting tooth 20 can include additional cutting elements, as necessary. Preferably, the cutting elements 30, 32 have a width corresponding to the width of the linear edge portion 46. However, the width of the cutting elements 30, 32 is not critical.

Referring now to FIG. 3, surface 36 is spaced apart from the surface 34 on the drill bit 10. The surface 36 is also positioned above the surface 34 so as to provide a pathway for the evacuation of dislodged material on to surface 34 and away from the bit cutting elements 26, 28, 30, and 32. The wall 38 is positioned parallel to the longitudinal axis 24 and perpendicular to the surfaces 34, 36 to separate the surfaces 34, 36. The wall 38, the cutting tooth 18, and the surface 34 define a pocket generally designated by the numeral 50 in FIG. 3 for removing dislodged material.

The drill bit 10 rotates to carve a working surface. The cutting elements 26, 28 and 30, 32 extend from the cutting teeth 18, 20 to contact and carve a working surface. Cutting elements 28, 30 are the first cutting elements to contact flat working surfaces because the apices of cutting elements 28, 30 extend furthest from the drill bit 10.

The asymmetric positioning of the cutting elements 26, 28 and 30, 32 produces a cutting pattern that includes a series of adjacent, concentric circular channels in a working surface, as the drill bit 10 rotates. Cutting element 30 contacts a working surface. As the drill bit 10 rotates, cutting element 30 carves a circular channel in a working surface. Cutting element 28 also contacts a working surface and carves a concentric, circular channel adjacent to the channel formed by cutting element 30.

As the drill bit 10 rotates, the cutting elements 26, 32 carve concentric, circular channels, in the same method accomplished by cutting elements 28 and 30. Cutting element 32 carves a concentric, circular channel adjacent to the channel formed by cutting element 28. Cutting element 26 carves a concentric, circular channel adjacent to a channel formed by cutting element 32.

Rotation of the drill bit 10 and the carving of a working surface by the cutting elements 26, 28 and 30, 32 dislodges material from the bore hole in the rock formation. The dislodged material falls from the working surface and collects in the pocket 50 on the drill bit 10. Dislodged material is directed into the pocket 50 and is removed therefrom by rotation of the drill bit 10 and the depositing of additional material as the drilling operation proceeds into the rock formation.

The cutting surface 22, and more particularly, the cutting elements 30, 32 are formed by coating a suitable substrate with a hard surface layer. The hard layer covers the entire drill bit or, alternatively, just the cutting surface 22 or cutting element 30, 32. The hard layer is formed from a suitable material, such as diamond, polycrystalline diamond, diamond-like carbon, cubic boron nitride (CBN), titanium (TiN) and carbon (C2 N2). The substrate is any suitable material, such as tungsten carbide, steel, or any other suitable metal or ceramic. In the preferred embodiments, the cutting elements are formed from a diamond, polycrystalline diamond, or diamond-like carbon coating.

The diamond, polycrystalline diamond, or diamond-like carbon coatings are applied using known manufacturing process. Such processes include processes for producing polycrystalline diamond (PCD) bits, thermally stable product (TSP) diamond bits, impregnated diamond bits, or surface set diamond bits. Processes for producing PCD bits are disclosed in U.S. Pat. Nos. 6,585,064, 5,743,346, 5,580,196, and 4,098,362, which are incorporated herein by reference. A process for producing a TSP diamond coating is disclosed in U.S. Pat. No. 4,259,090, which is incorporated herein by reference. Surface set diamond coatings may be made by sintering processes or by infiltration processes. U.S. Pat. No. 6,029,544 discloses a diamond drill bit that is coated by sintering and is incorporated herein by reference. U.S. Pat. No. 4,534,773 discloses a method for preparing a surface set diamond coating and is incorporated herein by reference. U.S. Pat. No. 4,211,294 discloses a method for preparing an impregnated diamond coating and is incorporated herein by reference. In the preferred embodiment, the coatings are applied using coating processes that are provided by American Diamond Tool of Salt Lake City, Utah.

Now referring to FIGS. 4–7 there is illustrated an embodiment of a drill bit 51 in which like elements are also identified by like numerals shown in FIGS. 1–3 for the drill bit 10. Contrary to the embodiment of the drill bit 10 illustrated in FIGS. 1–3, the cutting teeth 52, 54 differ in construction from the cutting teeth 18, 20 illustrated in FIGS. 1–3. First, cutting tooth 52 includes raised arcuate edge portions 56, 58 and lowered arcuate edge portions 60, 62. Cutting tooth 54 includes raised arcuate edge portions 64, 66 and lowered arcuate edge portions 68, 70.

Figure 6:
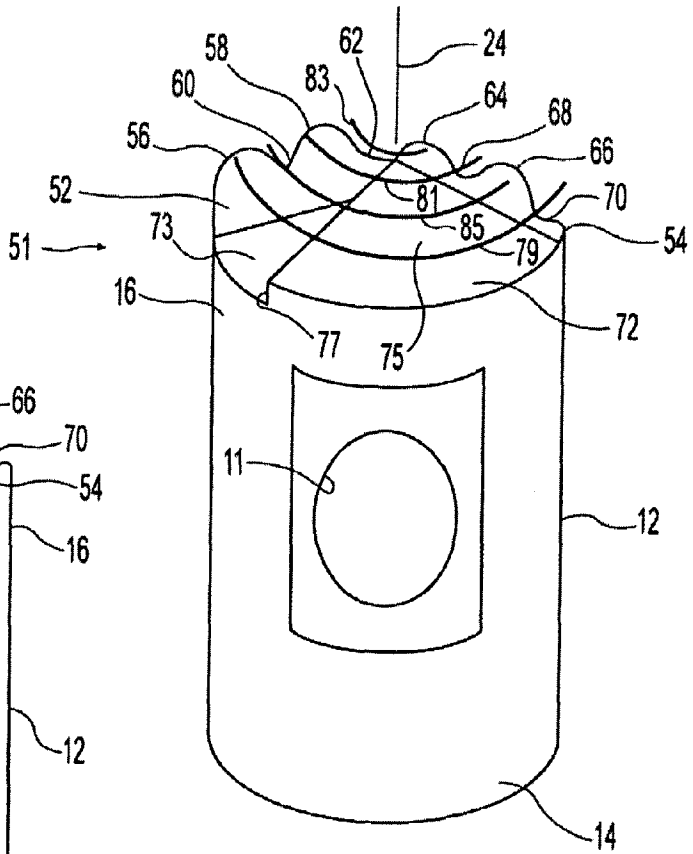
FIG. 6 is an isometric view of the drill bit shown in FIG. 4.
Figure 4:
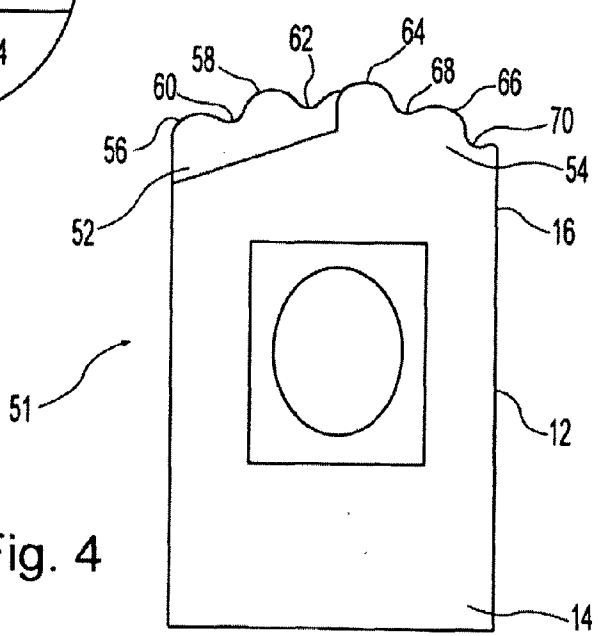
FIG. 4 is a view in side elevation of another embodiment of the drill bit, illustrating the asymmetrical arrangement of a pair of cutting teeth aligned with one another extending from the drill bit longitudinal axis.
Figure 5:
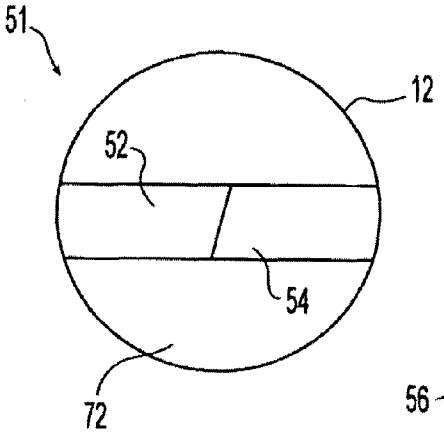
FIG. 5 is a sectional top plan view of the drill bit shown in FIG. 4.

As shown in FIG. 6, the cutting teeth 52, 54 are integral with a supporting surface 72 having surface portions 73 and 75 separated by a wall 77. The cutting tooth 52 extends from the surface 73, and the cutting tooth 54 extends from the surface 75, both in a direction parallel to a longitudinal axis 24 of body portion 12 that runs from the drill steel engaging portion 14 to the cutting end portion 16. In comparison with the embodiment of the cutting teeth 18 and 20 for the drill bit 10 shown in FIGS. 1–3, the cutting teeth 52 and 54 for the embodiment of the drill bit 10 shown in FIGS. 4–6 are longitudinally aligned across the diameter of the cylindrical body portion 12. The cutting teeth 52 and 54 are not laterally offset from one another as are the cutting teeth 18 and 20 as shown in FIG. 2. As shown in FIG. 5, the cutting teeth 52 and 54 form a one piece construction with an asymmetrical configuration, as above described. In this regard, the cutting teeth 52 and 54 also cut at a lower temperature and experience an extended operating life.

As shown in FIGS. 4 and 6, each cutting tooth 52, 54 includes a plurality of integral cutting elements 56, 58 and 64, 66. The cutting elements 56, 58 and 64, 66 are asymmetrically positioned from one another. The cutting elements 56, 58 and 64, 66 radiate outwardly from the center of the supporting surface 72. The cutting elements 56, 58 are spaced apart from one another on the cutting teeth 52. The cutting elements 64, 66 are spaced apart from one another on the cutting tooth 54. The cutting elements 56, 58 are raised relative to the surface 72 with respect to the edge portions 60, 62. The cutting elements 62, 64 are raised relative to the surface 72 with respect to the edge portions 68, 70. Each cutting element 56, 58, 62, 66 is positioned to create a unique cutting pattern on a working surface, as diagrammatically represented in FIG. 6 by the lines 79, 81, 83, and 85 which stimulate the cutting paths of the cutting elements 56, 58, 62, 66.

The first cutting element 56 is positioned adjacent to the cylindrical body portion 12. The second cutting element 58 is positioned between edge portions 60, 62. The cutting elements 56, 58 and the edge portions 60, 62 have arcuate edges to create a sinusoidal profile having the appearance of alternating peaks and valleys when viewed in perspective, as shown in FIGS. 4 and 6. Preferably, the cutting elements 56, 58 have a width corresponding to the width of the lowered arcuate edge portion 60. However, the width of the cutting elements 56, 58 is not critical.

The cutting elements 64, 66 of the second cutting tooth 54 are separated from one another by the lowered arcuate edge portion 68. The second cutting element 66 is positioned between the lowered arcuate edge portions 68, 70. Lowered arcuate edge portion 70 is positioned adjacent to the exterior surface 12. Lowered arcuate edge portion 62 abuts the cutting element 64 along the longitudinal axis 24. The cutting elements 64, 66 and the edge portions 68, 70 have arcuate edges to create a sinusoidal profile having the appearance of alternating peaks and valleys when viewed in perspective, as shown in FIGS. 4 and 6. Preferably, the cutting elements 64, 66 have a width corresponding to the width of the lowered arcuate edge portion 68. However, the width of the cutting elements 64, 66 is not critical.

Figure 7:
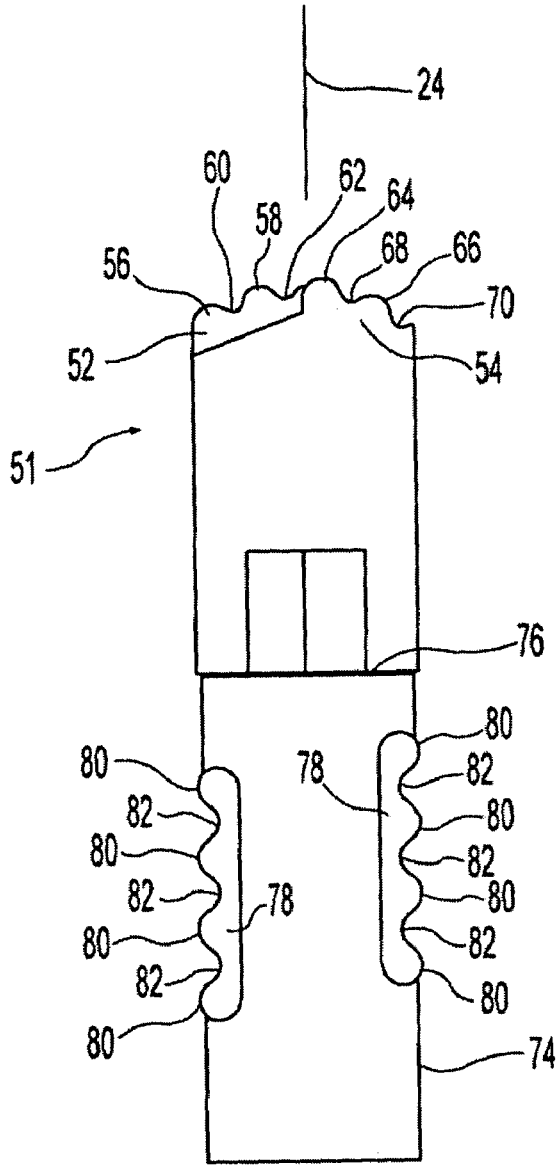
FIG. 7 is a view in side elevation of the drill bit shown in FIG. 4 attached to a reamer bit having cutting inserts extending therefrom.

Referring to FIG. 7, there is illustrated a reamer bit 74 attached to the drill bit 51 through conventional connection means 76. The reamer bit 74 connects to a drill steel, which is mounted in a conventional chuck assembly that allows the drill bit 51 and reamer bit 74 to rotate together as the drill bit 51 bores through rock material. The reamer bit 74 is generally cylindrical and includes a plurality of cutting inserts 78 extending therefrom.

The cutting inserts 78 are asymmetrically spaced from one another along the cylindrical outer surface of the reamer bit 74. Each insert 78 includes a plurality of cutting elements 80 and lower edge portions 82. The cutting elements 80 and edge portions 82 alternate along the longitudinal axis 24 of the reamer bit 74 in a sinusoidal manner to create the appearance of a row of peaks and valleys along the outer surface of reamer bit 74. The cutting elements 80 extend outwardly from the reamer bit 74 to dislodge additional rock material during drilling operations and to create a straight hole of substantially uniform diameter for advancement of the bit in the bore hole. The asymmetrical spacing of the cutting elements 80 produces a unique cutting pattern along the sides of the hole.

Figure 8:
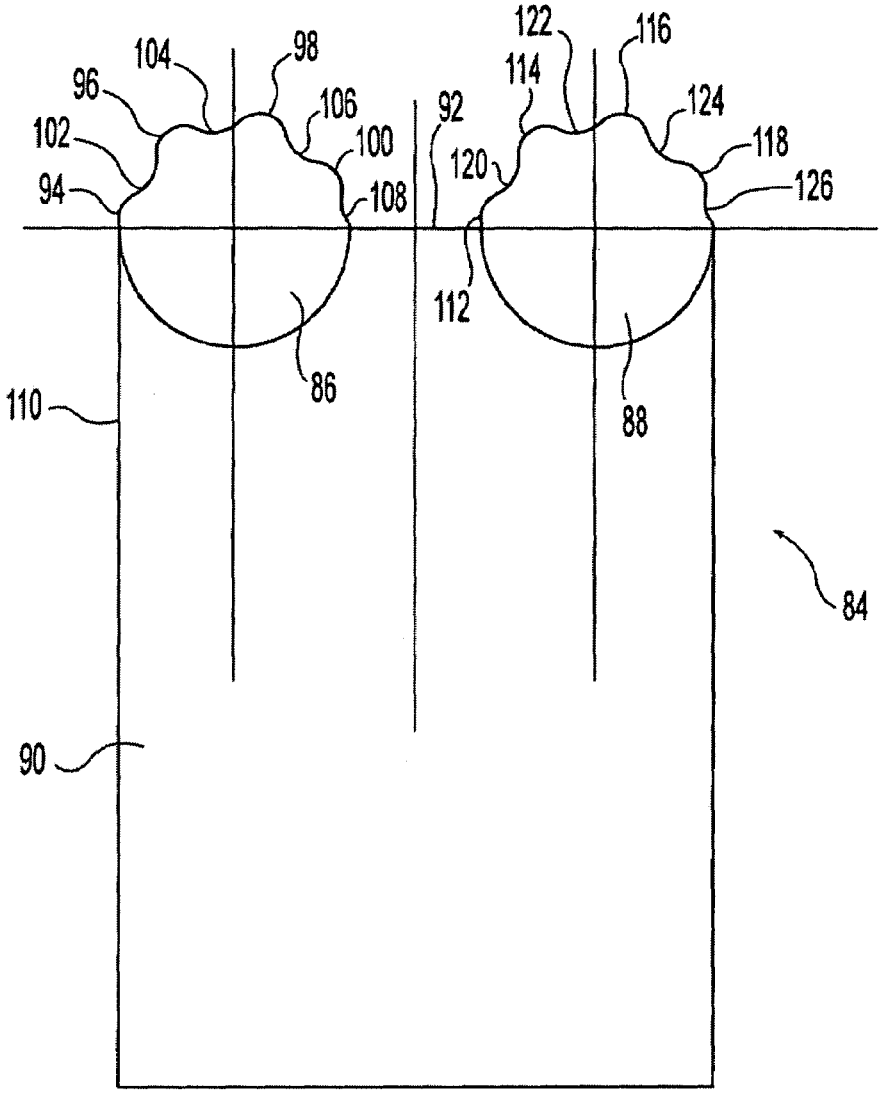
FIG. 8 is a view of the complete surface of a drill bit, illustrating the profiles of the pair of cutting teeth.

Now referring to FIG. 8, there is illustrated another embodiment of the present invention including a drill bit 84 in which like elements are also identified by like numerals shown in FIGS. 1–3. FIG. 8 illustrates the complete surface of the drill bit 84 laid out in a plane (development). Contrary to the embodiment illustrated in FIGS. 1–3, the cutting teeth 86, 88 differ in construction from the cutting teeth 18, 20 illustrated in FIGS. 1–3. The cutting teeth 86, 88 are inserts that extend from the cylindrical body portion 90 of the drill bit 84. Also, the cutting teeth 86, 88 do not abut one another. Instead, the cutting teeth 86, 88 are positioned along a surface 92 in a spaced apart manner.

The cutting teeth 86, 88 are asymmetrically spaced and juxtaposed from one another. Cutting tooth 86 includes a plurality of cutting elements 94, 96, 98, 100 with raised arcuate edges extending therefrom. Cutting tooth 86 also includes a plurality of lowered arcuate edge portions 102, 104, 106, 108. The cutting elements 94, 96, 98, 100 alternate positions with the lowered edge portions 102, 104, 106, 108 along the outer surface of the cutting tooth 86. The cutting element 94 is positioned adjacent to an outer surface 110 of the drill bit 84. The edge portion 108 is positioned adjacent to the surface 92.

Cutting tooth 88 includes a plurality of cutting elements 112, 114, 116, 118 with raised arcuate edges extending therefrom. Cutting tooth 88 also includes a plurality of lowered arcuate edge portions 120, 122, 124, 126. The cutting elements 112, 114, 116, 118 alternate positions with the lowered edge portions 120, 122, 124, 126 along the outer surface of the cutting tooth 88. The edge portion 126 is positioned adjacent to an outer surface 110 of the drill bit 84. The cutting element 112 is positioned adjacent to the surface 92. The lower edge portion 108 is positioned opposite to and faces the cutting element 112 along the surface 92.

The cutting teeth 86, 88 are offset from one another to produce a unique cutting pattern during drilling operations. As the drill bit 84 rotates, cutting element 98 extends from cutting tooth 86 to contact the drilling surface and to carve a circular trough in the rock material. Cutting element 116 extends from cutting tooth 88 to contact the drilling surface and to carve a second concentric circular trough in the rock material, which is adjacent to the trough created by cutting element 98. The remaining cutting elements 94, 96, 100, 112, 114, 118 carve similar concentric troughs in the drilling surface.

It should be understood that alternative drill bits are contemplated in accordance with the present invention and include drill bits having inserts, and more particularly, inserts that have asymmetrically positioned cutting elements. The inserts comprise cutting teeth with cutting elements or cutting elements alone.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A drill bit comprising:

a cylindrical body portion having a longitudinal axis and a cutting end portion, a pair of cutting teeth positioned on said cutting end portion, each cutting tooth extending radially, outwardly from the longitudinal axis of said cylindrical body portion, each cutting tooth including a plurality of raised cutting elements connected to a plurality of lower edge portions, and said cutting teeth juxtaposed from one another with a lower edge portion on one tooth abutting a raised cutting element on said other tooth on the longitudinal axis of said cylindrical body portion.

2. A drill bit as set forth in claim 1 in which:
said cutting elements include arcuate edge portions, and said lowered edge portions include linear edge portions.

3. A drill bit as set forth in claim 2 in which:
said cutting end portion includes at least one cutting surface,
at least one of said cutting teeth extends from said cutting end portion cutting surface, and
said linear edge portions of said teeth are sloped relative to said cutting end portion cutting surface.

4. A drill bit as set forth in claim 2 in which:
said linear edge portions correspond in width to the width of said cutting elements.

5. A drill bit as set forth in claim 1 which includes:
a pocket for removing dislodged material.

6. A drill bit as set forth in claim 5 in which:
said cutting end portion includes a first support surface and a second support surface,
said first cutting tooth extends from said first support surface and said second cutting tooth extending from said second support surface, and
a wall separates said first and second support surfaces, and
said wall, said second cutting tooth, and said second support surface form said pocket.

7. A drill bit as set forth in claim 1 in which:
said cutting teeth are offset from one another on said longitudinal axis.

8. A drill bit as set forth in claim 1 in which:
a layer of hard material coating said cutting teeth at least partially to form said cutting elements.

9. A drill bit as set forth in claim 8 in which:
said hard layer is formed from a material selected from the group consisting of diamond, polycrystalline diamond, diamond-like carbon, thermally stable product diamond, impregnated diamond, surface set diamond, cubic boron nitride, titanium nitride, and carbon nitride.

10. A drill bit for drilling a hole in a drilling surface comprising:
a cylindrical body portion having a longitudinal axis and a cutting end portion,
a pair of opposing cutting teeth positioned on said cutting end portion,
each cutting tooth extending radially, outwardly from the longitudinal axis of said cylindrical body portion,
said first cutting tooth having a cutting element for carving a first circular hole in the drilling surface,
said second cutting tooth having a cutting element asymmetrically spaced from said cutting element of said first cutting tooth for carving a second, concentric circular hole in the drilling surface adjacent to the first circular hole, and
said cutting end portion having a pocket for removing dislodged material.

11. A drill bit as set forth in claim 10 which includes:
each cutting tooth including a plurality of cutting elements connected by a plurality of lowered edge portions.

12. A drill bit as set forth in claim 11 in which:
said cutting end portion includes a cutting surface,
at least one of said cutting teeth extends from said cutting surface, and
said lowered edge portions of each tooth are sloped relative to said cutting end portion cutting surface.

13. A drill bit as set forth in claim 10 in which:
said cutting end portion includes a first support surface and a second support surface,
said first cutting tooth extending from said first support surface, and
said second cutting tooth extending from said second support surface.

14. A drill bit as set forth in claim 13 which includes:
a wall separating said first and second support surfaces, and
said wall, said second cutting tooth, and said second support surface forming said pocket.

15. A drill bit as set forth in claim 10 in which:
each cutting element includes an arcuate edge.

16. A drill bit as set forth in claim 10 in which:
said cutting teeth are offset from one another on said longitudinal axis.

17. A drill bit as set forth in claim 10 which includes:
said cutting teeth being aligned with one another on said longitudinal axis.

18. A drill bit as set forth in claim 10 which includes:
a layer of hard material coating said cutting teeth at least partially to form said cutting elements.

19. A drill bit as set forth in claim 18 which includes:
said hard layer is formed from a material selected from the group consisting of diamond, polycrystalline diamond, diamond-like carbon, thermally stable product diamond, impregnated diamond, surface set diamond, cubic boron nitride, titanium nitride, and carbon nitride.

20. A method for drilling a hole in a working surface comprising the steps of:
extending a first cutting tooth on a drill bit in a direction parallel to the longitudinal axis of the drill bit,
extending a second cutting tooth on the drill bit in a direction parallel to the longitudinal axis,
positioning the first cutting tooth in abutment with and offset from the second cutting tooth on the longitudinal axis,
contacting a first cutting element of the first cutting tooth with the working surface,
rotating the drill bit to carve a first circular channel in the working surface with the first cutting element,
contacting a second cutting element on the second cutting tooth with the working surface, and
rotating the drill bit to carve a second circular channel adjacent to the first circular channel in the working surface with the second cutting element.

21. A method as set forth in claim 20 which includes:
extending the first cutting tooth from a first support surface on the drill bit, and
extending the second cutting tooth from a second support surface on the drill bit.

22. A method as set forth in claim 21 which includes:
removing dislodged material from a pocket formed by a wall separating the first and second support surfaces.

23. A method as set forth in claim 20 which includes:
carving a plurality of concentric channels in the working surface with a plurality of cutting elements extending from the first cutting tooth, and
carving a plurality of concentric channels in the working surface with a plurality of asymmetrically spaced cutting elements extending from the second cutting tooth.

24. A drill bit for drilling a hole in a drilling surface comprising:
a cylindrical body portion having a longitudinal axis and a cutting end portion, a pair of opposing cutting teeth positioned on said cutting end portion, each cutting tooth extending radially, outwardly from the longitudinal axis of said cylindrical body portion, means for carving a first circular hole in the drilling surface extending from said first cutting tooth, and means for carving a second, concentric circular hole in the drilling surface adjacent to the first circular hole extending from said second cutting tooth abutting said first cutting tooth carving means.

25. A drill bit as set forth in claim 24 which includes: means for removing dislodged material.

* * * * *